US006002364A

United States Patent [19]

Kroeger et al.

[11] Patent Number: 6,002,364

[45] Date of Patent: Dec. 14, 1999

[54] APPARATUS AND METHOD FOR BEAM STEERING CONTROL SYSTEM OF A MOBILE SATELLITE COMMUNICATIONS ANTENNA

[75] Inventors: Brian William Kroeger, Sykesville; Paul James Peyla, Elkridge, both of Md.

[73] Assignee: CBS Corporation, Pittsburgh, Pa.

[21] Appl. No.: 08/903,676

[22] Filed: Jul. 31, 1997

[51] Int. Cl.[6] ..... H01Q 3/00

[52] U.S. Cl. ..... 342/359; 343/757

[58] Field of Search ..... 342/359; 343/757

[56] References Cited

U.S. PATENT DOCUMENTS

| | | | |
|---|---|---|---|
| 4,590,476 | 5/1986 | Burkett | 343/7.4 |
| 4,630,056 | 12/1986 | Noguchi | 342/357 |
| 4,675,688 | 6/1987 | Sahara et al. | 343/765 |
| 4,725,843 | 2/1988 | Suzuki et al. | 342/359 |
| 4,841,303 | 6/1989 | Anderson | 342/359 |
| 5,166,693 | 11/1992 | Nishikawa et al. | 342/422 |
| 5,241,319 | 8/1993 | Shimizu | 342/358 |
| 5,274,382 | 12/1993 | Wills et al. | 342/359 |
| 5,297,028 | 3/1994 | Ishikawa | 364/571.03 |
| 5,398,035 | 3/1995 | Densmore et al. | 343/713 |
| 5,463,401 | 10/1995 | Iwasaki | 342/359 |
| 5,557,285 | 9/1996 | Bender et al. | 342/359 |
| 5,764,185 | 6/1998 | Fukushima et al. | 342/359 |
| 5,828,337 | 10/1998 | Aoshima et al. | 342/359 |

*Primary Examiner*—Gregory C. Issing
*Attorney, Agent, or Firm*—Robert P. Lenart; Eckert Seamans Cherin & Mellott, LLC

[57] ABSTRACT

A beam steering control for a mobile satellite communications antenna, includes an antenna having a steering mechanism; a dynamic rate sensor for producing a signal related to the rate of change of position of a vehicle to which the antenna is mounted; and a control system for controlling the steering mechanism, the control system including a satellite tracking loop, an inertial stabilization loop, a calibration algorithm for dynamically calibrating the rate sensor, and a satellite acquisition algorithm for determining a azimuth angle of the antenna relative to an inertial reference. A method for beam steering a mobile satellite communications antenna, includes mounting an antenna on a steering mechanism; using a dynamic rate sensor to produce a signal related to the rate of change of position of a vehicle to which the antenna is mounted; and controlling the steering mechanism, using a control system including a satellite tracking loop, an inertial stabilization loop, a calibration algorithm for dynamically calibrating the rate sensor, and a satellite acquisition algorithm for determining a azimuth angle of the antenna relative to an inertial reference. Special techniques are employed to tolerate signal outages in a fading communication channel, while other techniques are employed to overcome practical and economical limitations of the hardware.

19 Claims, 12 Drawing Sheets

APPARATUS AND METHOD FOR BEAM STEERING CONTROL SYSTEM OF A MOBILE SATELLITE COMMUNICATIONS ANTENNA

BACKGROUND OF THE INVENTION

This invention relates to apparatus and methods for steering communications antennas and, more particularly, to such apparatus and methods which are used in combination with vehicle mounted antennas.

Satellite communications systems, in which mobile voice and/or data terminals communicate directly with a satellite, are well known. When such systems utilize geosynchronous satellites, the mobile terminals must be able to receive extremely weak signals due to the large distance over which the signal must travel. It is therefore important that the antennas connected to the mobile terminals are positioned to achieve maximum signal gain. When the mobile terminals are mounted on vehicles, a control system is required so that the antenna can track the satellite as the vehicle moves along the surface of the earth. This inventions seeks to provide an economically feasible control system which is capable of tracking a satellite during vehicle movement and when the signal is temporarily blocked by structures or terrain.

SUMMARY OF THE INVENTION

A beam steering control for a mobile satellite communications antenna, constructed in accordance with this invention includes an antenna having a steering mechanism; a dynamic rate sensor for producing a first signal related to the rate of change of position of a vehicle to which the antenna is mounted; and a control system for controlling the steering mechanism in response to the first signal, the control system including a satellite tracking loop, an inertial stabilization loop, means for dynamically calibrating the rate sensor, and a satellite acquisition means for determining an azimuth angle of the antenna relative to an inertial reference.

The invention also encompasses a method for beam steering a mobile satellite communications antenna, including mounting an antenna on a steering mechanism; using a dynamic rate sensor to produce a first signal related to the rate of change of position of a vehicle to which the antenna is mounted; and controlling the steering mechanism in response to the first signal, using a control system including a satellite tracking loop, an inertial stabilization loop, means for dynamically calibrating the rate sensor, and a satellite acquisition means for determining an azimuth angle of the antenna relative to an inertial reference.

DESCRIPTION OF THE PREFERRED EMBODIMENTS

Figure 1:
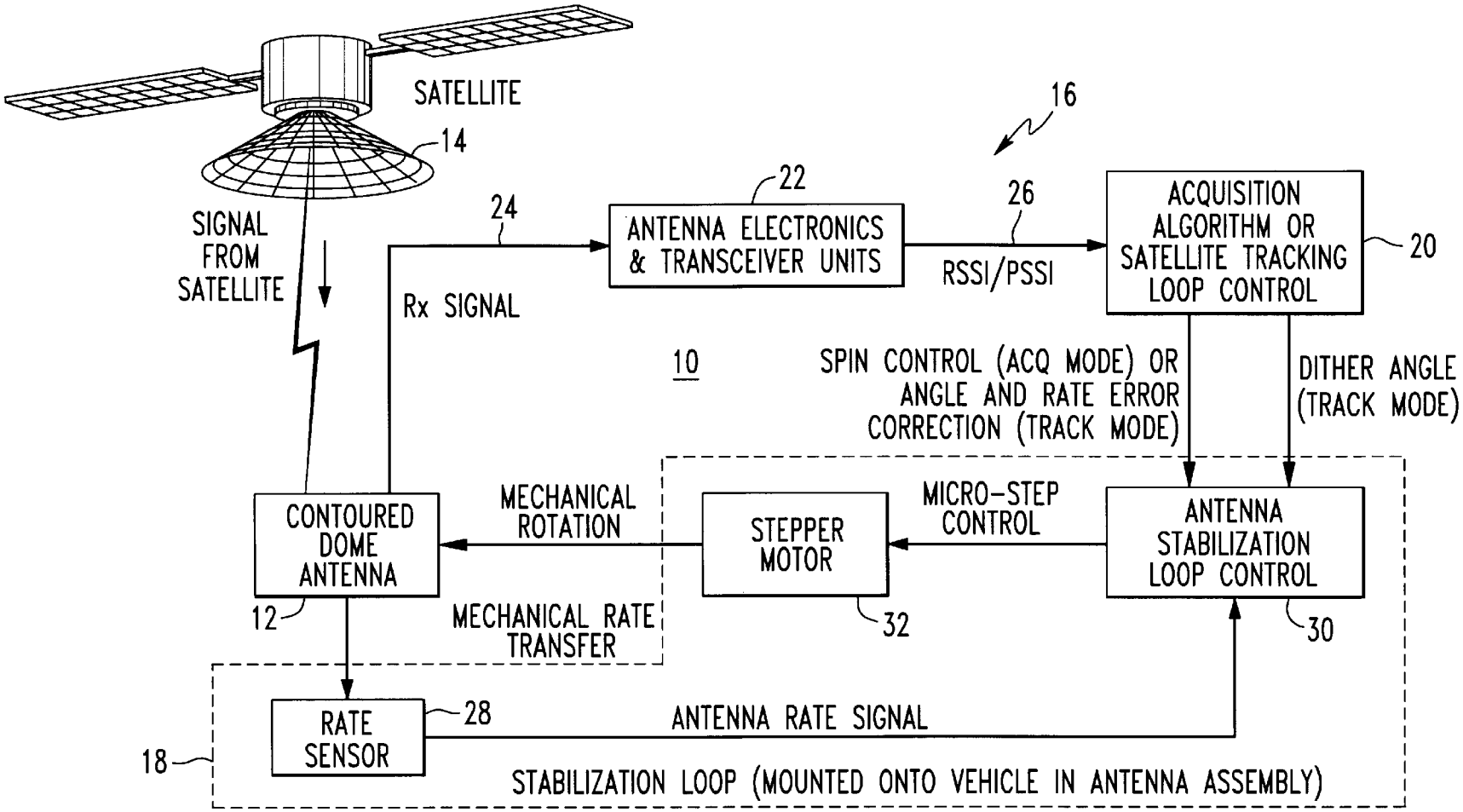
FIG. 1 is a block diagram of an antenna beam steering system constructed in accordance with the preferred embodiment of the invention.

Referring to the drawings, wherein like reference numerals refer to like components in the various figures, FIG. 1 is a block diagram of a antenna beam steering control (BSC) system 10 constructed in accordance with the preferred embodiment of the invention. This invention is used in conjunction with an antenna 12, which is capable of being mechanically scanned. The antenna transmits to and receives signals from a satellite 14, which may be a geosynchronous satellite. The control system includes a satellite tracking loop (STL) 16 and an inertial stabilization loop (ISL) 18. The satellite tracking loop includes a satellite tracking loop control 20 which receives a signal that is representative of a signal received by the antenna. In the preferred embodiment, an antenna electronics unit and transceiver unit 22 receives a signal from the antenna on line 24 and transmits either a Receive Signal Strength Indicator (RSSI) signal or the Pilot Signal Strength Indicator (PSSI) signal to the satellite tracking loop control on line 26. The satellite tracking loop, with the aid of an inertial stabilization loop, finds the azimuth angle of the antenna relative to an inertial reference, independent of the vehicle turns.

The inertial stabilization loop 18 includes a dynamic turn rate sensor 28, an antenna stabilization loop control 30, which may be a microcontroller, and a stepper motor 32. The stabilization loop maintains the azimuth angle of the antenna relative to an inertial reference (the earth, or a communications satellite) independent of the vehicle motion (e.g. turns) such that the antenna continues to point to the satellite even when the signal is lost due to a temporary blockage. The purpose of the BSC is to keep the vehicle-mounted antenna pointed at the satellite even while the vehicle turns. The STL includes the Satellite Tracking Loop Control, the Antenna Electronics Unit, the Transceiver Unit, and the Stabilization Loop components of FIG. 1. The purpose of the STL is to keep the antenna pointed toward the direction of maximum signal as indicated by either the RSSI or a PSSI signal as detected and estimated within the Transceiver Unit. The scope of this invention includes the Satellite Tracking Loop Control functions, the Stabilization Loop functions with turn rate calibration, and Satellite Acquisition functions. Important features of this control system include the methods of digital signal processing for fade mitigation, voice activation, blockages, signal and component gain variations, and the methods of self-calibration, normalization and compensation, and methods to deal with signals over a large dynamic range which permit the use of very low cost, but reliable, hardware components.

This particular stabilization technique is implemented as a feedback control loop consisting of the antenna to be stabilized, a turn rate sensor mounted with the antenna on an electric motor-powered rotatable assembly, and a microcontroller which monitors the rate sensor and completes the feedback control function by controlling the motor. A turn rate sensor aids the beam steering apparatus in a mobile beam steered antenna. The commercially available turn rate sensor used in the preferred embodiment of the invention outputs a voltage proportional to the turn rate (e.g. 22.2 mV/(deg/sec)) of the vehicle. In addition, the signal voltage output of this turn rate sensor has an arbitrary dc voltage offset. If the dc voltage offset is not compensated (or subtracted) from the output signal, an arbitrary turn rate will be added to the real turn rate output. Therefore a method for estimating this dc offset voltage is needed. This invention provides a calibration technique that functions well when the vehicle is moving without restricting the driving conditions of the vehicle (which is a significant challenge).

Figure 2:
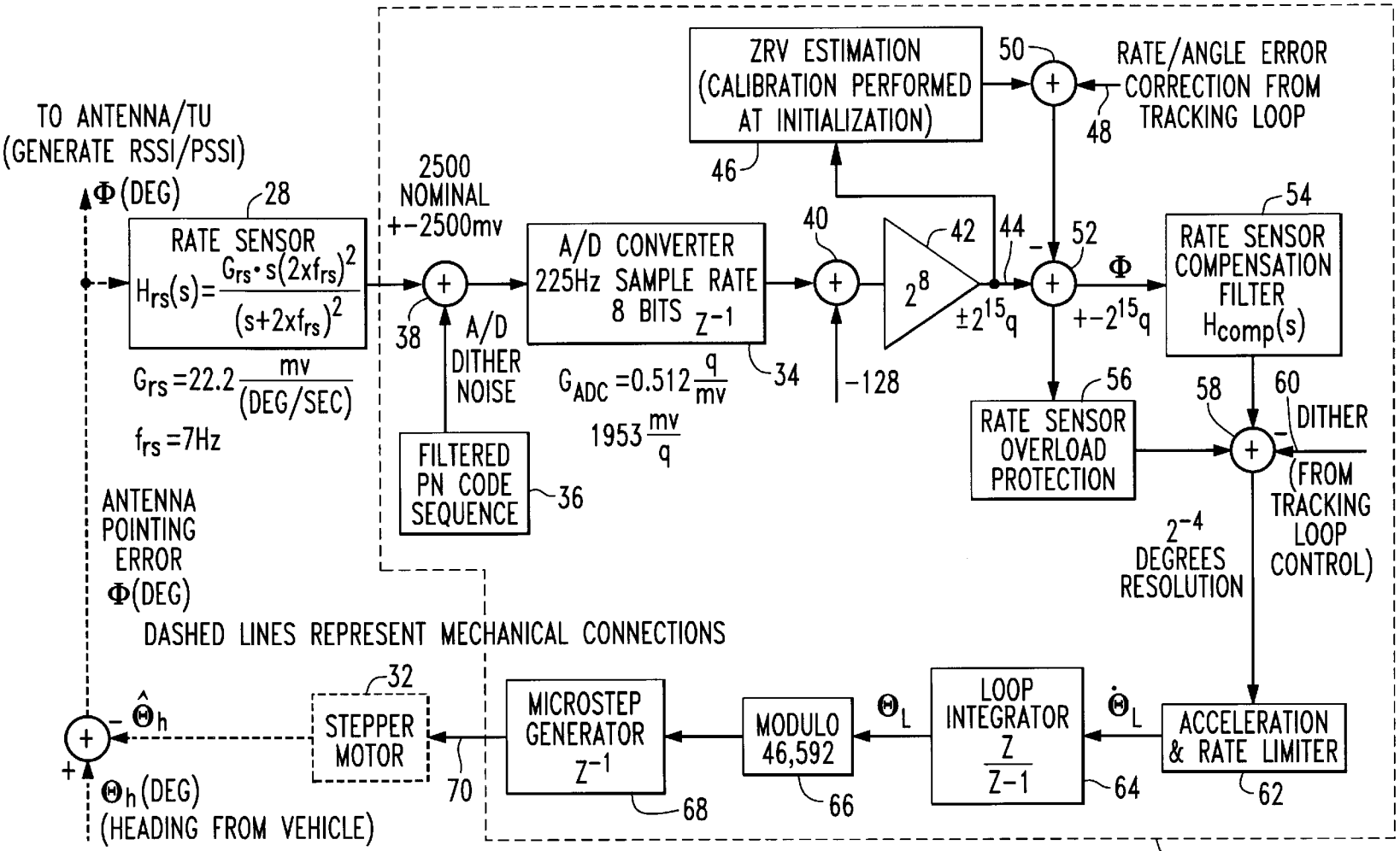
FIG. 2 is a block diagram of the mobile antenna inertial stabilization loop of the controller of the system of FIG. 1.

A functional top-level block diagram of the Inertial Stabilization Loop is shown in FIG. 2. This functional diagram is a mixed s-domain and z-domain model of the Stabilization Loop representing the analog and digital components, respectively. This model was exercised on a computer using a z-domain simulation after converting the s-domain functions into z-domain via the bilinear transform approximation. The purpose of the Stabilization Loop is to maintain the azimuth angle of the antenna relative to an inertial reference (the earth, or a communications satellite) independent of the vehicle motion (e.g. turns) such that the antenna continues to point to the satellite even when the signal is lost due to a temporary blockage. The complementary functions of the Satellite Tracking Loop (STL) and the Stabilization Loop within the STL provide both long term and short term stability, respectively. A rate-sensor-based stabilization technique is implemented as a feedback control loop including the antenna to be stabilized, the turn rate sensor 28 mounted with the antenna on an electric motor-powered rotatable assembly, and a microcomputer which monitors the rate sensor via an ADC and completes the feedback control functions by controlling the motor. This Stabilization Loop is intended to compensate for antenna angular (yaw) motions over a relatively short time (e.g. less than one minute). Stability over a much longer time is prevented in the Stabilization Loop because of calibration inaccuracies of the rate sensor offset, and due to rate sensor drift over time and temperature. The complementary function of the Satellite Tracking Loop provides the long term absolute tracking accuracy while the Stabilization Loop compensates for quick turns which cannot be compensated quickly by the Satellite Tracking Loop.

The Stabilization Loop employs a (turn) rate sensor 28 to measure the vehicle turning rate. The output of the rate sensor is sampled with an A/D converter 34 where the input range is 0 to 5 volts. The sensitivity of one particular (but typical) rate sensor is 22.2 mV/deg/sec and the Zero Rate Voltage (ZRV), when the sensor is not spinning, is about 2.5 volts±0.6 volts (uncalibrated). The ±0.6 volts uncertainty corresponds to ±27 degrees/sec which is not acceptable for satellite tracking. The uncertainty includes unit to unit variations as well as temperature sensitivity. After the rate sensor is initially calibrated and the satellite is acquired (tracking mode) the rate sensor offset is continually estimated and is updated at a very slow rate to accommodate temperature drift.

The initial rate offset calibration problem would be somewhat trivial if the vehicle were required to be stopped for the calibration. If the vehicle were stopped, then a sample of the rate sensor output would reflect the offset voltage which could be subsequently subtracted from the future samples to yield the true rate output (without offset). The goal of the calibration technique is to estimate the ZRV while the vehicle is moving under normal driving conditions. The residual error of this ZRV estimate should result in a rate of less than 1 degree per second. Another goal is to estimate the ZRV in minimum time so that the Mobile Terminal is usable shortly after power-up. If the ZRV is not calibrated within a reasonable margin from the specified tolerance, then it is likely that the antenna cannot acquire the satellite signal and a large time penalty is subsequently incurred after searching all other satellite beams. The error tolerance of 1 degree/sec is intended to allow a signal blockage of up to 15 seconds before the signal is lost from the antenna beam (assuming at least a ±15 degrees beamwidth antenna pattern). Both the Stabilization Loop and the Tracking Loop of the antenna assembly are disabled during this ZRV calibration mode.

Intuitively, one might suggest that the ZRV can be estimated by computing the mean of samples of the Rate Sensor output taken over a sufficiently long time. After some thought it becomes clear that the mean could be biased and/or affected by an imbalance of clockwise and counterclockwise turns incurred over the duration of the samples. Even very long sample durations are prone to a bias since modern highways are designed to favor right turns over left (e.g. cloverleaf ramps), and the ZRV can drift due to temperature changes. Furthermore, very long averaging durations defeat the goal of fast calibration time.

The ZRV calibration algorithms described here attempt to exploit observed properties of the probability density function of the rate sensor samples with vehicle motion and turns. Also, the execution time is variable since an algorithm is used to dynamically estimate when a sufficient number of samples has been processed to yield a high probability of accurately estimating the ZRV. An additional algorithm is executed in parallel which estimates the ZRV more quickly when it detects that the vehicle has stopped.

An Acquisition (search) algorithm is required to initially point the antenna toward the satellite. The Acquisition algorithm must position the antenna such that the satellite is within the main beam while preventing acquisition in an antenna sidelobe. Furthermore, the algorithm must be tolerant of vehicle turning and signal fades and blockages while acquiring in minimum time.

It is noteworthy that a compass is typically used in place of the rate sensor as the reference device. Based on our analysis and testing, the compass is subject to anomalies due to local ferrous objects (e.g. bridges, ore deposits, or the vehicle itself) as well as geographic anomalies. Although the compass has no long term drift error characteristic of the rate sensor, the anomalies present a problem that cannot easily be corrected when they occur. Furthermore, long term stability is provided by the tracking loop which is needed in each case to locate and track the satellite.

The s-domain transfer function $H_{rs}$ (s) of the rate sensor is shown in the Rate Sensor block of FIG. 2. The factor s in the numerator indicates that the rate sensor is modeled as a differentiator such that it accepts an angle input over time, and outputs a signal proportional to the turn rate. The rate sensor also is modeled with a double pole at $f_{rs}$=7 Hz. The double pole and differentiator are compensated by the Rate Sensor Compensation Filter to enhance stability and performance of the Stabilization Loop. The output of the rate sensor is a voltage ranging from about zero to 5 volts. Under zero rate conditions (i.e. not turning), the rate sensor outputs nominally 2.5+−0.6 volts. The +−0.6 volts uncertainty results from manufacturing tolerances and temperature of the rate sensor.

The analog signal output from the rate sensor is digitized by an 8-bit A/D converter 34 (located within the microcontroller) clocked at a sample rate of 225 Hz. Although the useful bandwidth of the loop is under 7 Hz, oversampling the signal reduces the effective A/D delay and allows a higher resolution to be achieved when performed in conjunction with lowpass loop filtering and the A/D dither noise from the PN Code Sequence Generator 36 which is inserted by way of summation point 38. In effect, the mean of the A/D samples (due to lowpass filtering by the loop) has more resolution than any one sample. Specifically, one additional bit of resolution can be achieved for each quadrupling of the sample rate when the dither noise is sufficiently large to decorrelate the quantization noise from the signal output. In this case the effective resolution was increased from 8 bits to more than 10 bits, or better than 12 dB SNR improvement. The dither noise permitted the use of the 8-bit A/D converter internal to the microprocessor instead of a 10-bit A/D converter, thereby resulting in a cost savings. Without the dither improvement, the accumulated results of quantization noise would cause the stabilization loop to drift resulting in substantial pointing error. Simulation verified the effects of the quantization noise without dither noise, and the improvement achieved with the dither noise.

The output of the A/D converter is scaled through summation point 40 and amplifier 42 to produce a scaled digital output on line 44. The A/D output is multiplied by $2^8$ by placing the A/D byte in the most significant byte of a 16-bit word to yield more resolution for subsequent processing. The zero rate voltage (ZRV) calibration value from ZRV estimation block 46 and the angle and rate corrections on line 48 from the Satellite Tracking Loop Control are added in summation point 50 and subtracted from the scaled A/D output as illustrated by summation point 52. This yields a scaled turn rate signal while removing the arbitrary dc offset. The details of the ZRV calibration and Satellite Tracking Loop Control functions are discussed below. This calibrated and corrected rate signal is next applied to both the Rate Sensor Compensation Filter 54 and the Rate Sensor Overload Protection 56 functions prior to the addition (via summation point 58) of a dither signal on line 60 from the Tracking Loop Control. The output of summation point is processed by an acceleration rate limiter 62, a loop integrator 64, a modulo 46,592 66 and a microstep generator 68, to produce a control signal for the stepper motor 32 on line 70. The stepper motor drives the antenna in combination with the heading of the vehicle to produce the desired antenna orientation.

Figure 3:
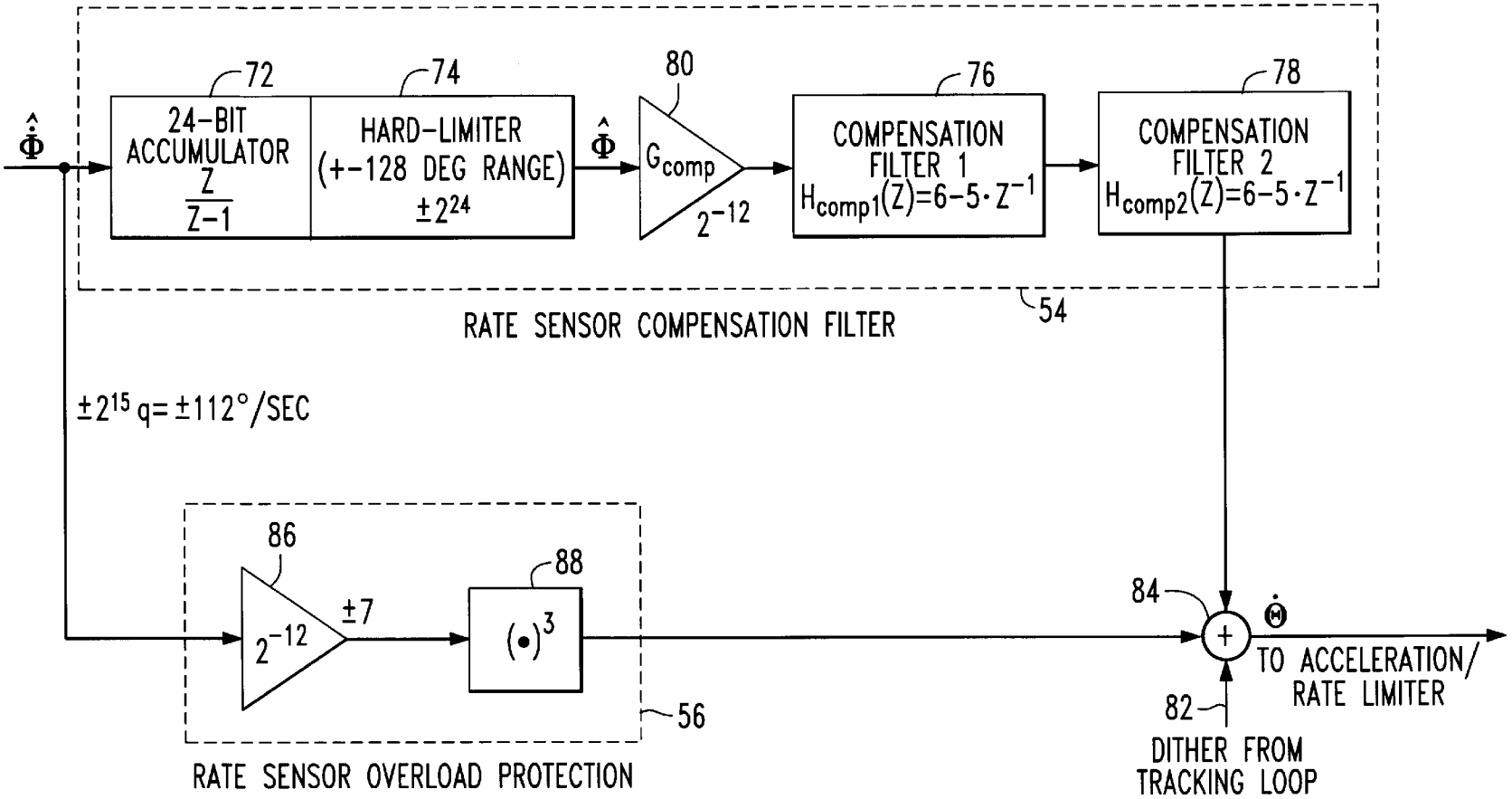
FIG. 3 is a block diagram of the rate sensor compensation filter and rate sensor overload protection used in the system of FIG. 1.

The functional details of the Rate Sensor Compensation Filter are illustrated in FIG. 3. The rate compensation includes a 24-bit Accumulator 72 (digital approximation of an integrator, 24 bits prevents accumulator overflow while maintaining resolution) with hard limiter 74 to compensate for the s differentiator factor in $H_{rs}$ (s), and a pair of digital high-pass filters 76, 78, $H_{comp1}$ (z) and $H_{comp2}$ (z), to compensate for the pole pair in $H_{rs}$ (s). The gain $G_{comp}=2^{-12}$ illustrated by amplifier 80, completes the loop with the appropriate gain after all other gain factors are fixed. The dither control signal from the Satellite Tracking Loop Control is inserted on line 82 through summation point 84 after the Rate Sensor Compensation Filter.

Figure 4:
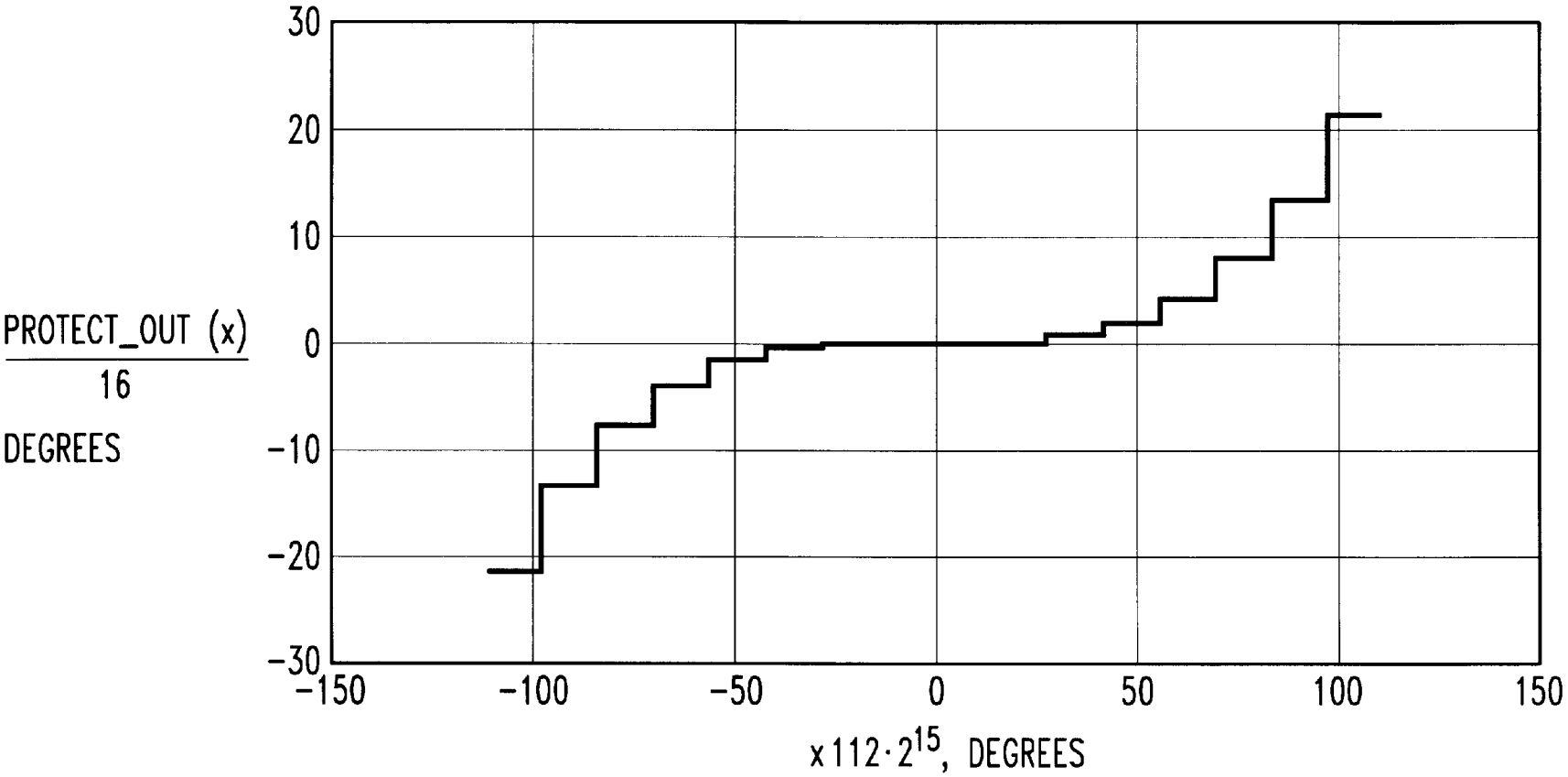
FIG. 4 shows the input vs. output characteristic of the rate sensor overload protection function of the system of FIG. 1.

The purpose of the Rate Sensor Overload Protection is to increase the magnitude of the signal when it senses that the turn rate is approaching the limits of the rate sensor. In effect, increasing the magnitude of the negative feedback at this point in the loop applies the "brakes" to the stepper motor before the rate sensor is saturated. This is achieved in a nonlinear manner by applying increasingly higher angle magnitude corrections as the msbs of the rate input to the overload protection increase in magnitude. This is implemented by shifting the 15-bit plus sign input value 12 places to the right (as illustrated by amplifier 86), then cubing the shifted value. The input to the cube function 88 is a 3-bit plus sign value which coarsely quantizes the msbs of the input over −7 to +7. The cube function increases the correction value dramatically as the input increases while retaining the polarity of the input as shown in the plot of FIG. 4. Notice the linear range about zero where no protection is applied over about ±14 deg/sec rate input values representing ⅛ the peak-to-peak input range.

Figure 5:
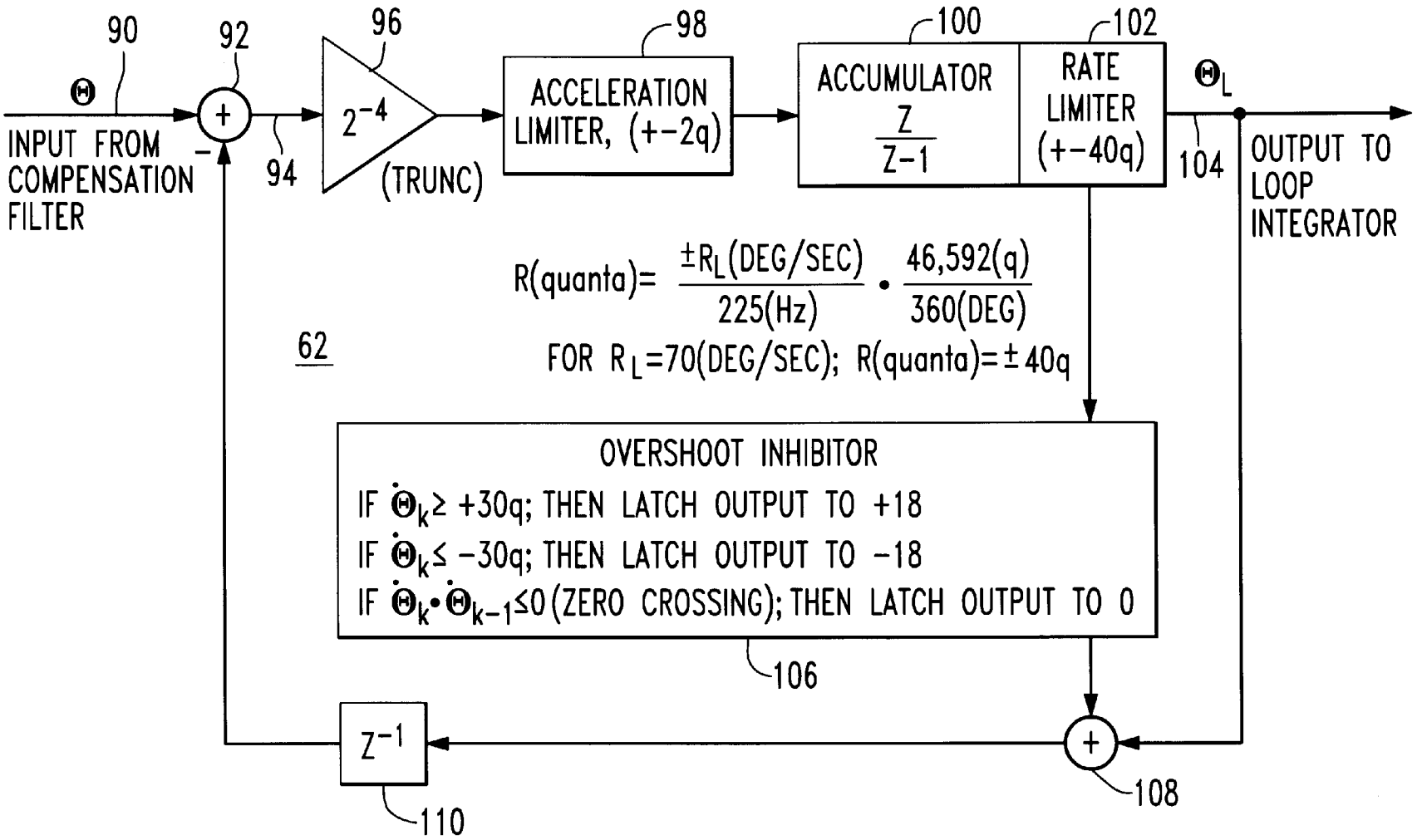
FIG. 5 is a block diagram of an acceleration/rate limiter which accommodates limitations of the stepper motor.

A functional block diagram of the Acceleration/Rate Limiter 62 is presented in FIG. 5. The Acceleration/Rate Limiter is necessary to limit the angular acceleration and rate applied to the stepper motor used in this application. If a conventional dc motor were used, the acceleration and rate would be self-limiting. However, a stepper motor was chosen here for increased reliability and lower cost than a comparable brushless dc motor. If the acceleration or rate limitations of the stepper motor are exceeded, then the stepper motor could lose "lock" by skipping steps, or stop completely. The feedback control loop effect causes an input 90 at the input of the Acceleration/Rate Limiter to behave as a rate control for the stepper motor. The input on line 90 from the compensation filter is combined with a feedback signal in summation point 92 to produce a signal on line 94 that is truncated as illustrated by amplifier 96 and processed by an acceleration limiter 98 and an accumulator 100 and rate limiter 102 to produce a rate output signal $\theta_L$ on line 104. This is because of the Loop Integrator (64 in FIG. 2) between the stepper motor angular control and this point of the closed loop. Notice also that the Acceleration/Rate Limiter is itself a closed loop where the rate output $\theta_L$ is servoed through overshoot inhibitor 106 summation point 108 and inverter 110 to the rate input. The Accumulator (integrator) preceding the Rate Limiter within this loop has the effect of an acceleration input since acceleration is the derivative of the rate. The servo action allows the desired acceleration and rate limiting without the introduction of a steady state error component due to the nonlinear limiting within the Acceleration/Rate servo loop.

The Loop Integrator accumulates rate samples $\theta_L$ at 225 Hz (sample rate). Since an accumulated value of 46,592 (the modulus) represents 360 degrees of the antenna, then each quanta of accumulated input from the Rate Limiter represents approximately 1.74 deg/sec rate. A Rate Limiter value of 40 quanta is equivalent to about a 70 deg/sec rate limit.

$$R_{deg/sec} = R_{quanta} \cdot \frac{225_{Hz} \cdot 360_{deg/cycle}}{46{,}592_{quanta/cycle}}$$

The acceleration value can be computed in a manner similar to the rate. Since each quanta of acceleration corresponds to approximately 391 deg/sec$^2$, an acceleration limit of 2 is equivalent to about 782 deg/sec$^2$.

$$A_{deg/sec^2} = A_{quanta} \cdot \frac{(225_{Hz})^2 \cdot 360_{deg/cycle}}{46{,}592_{quanta/cycle}}$$

Figure 6:
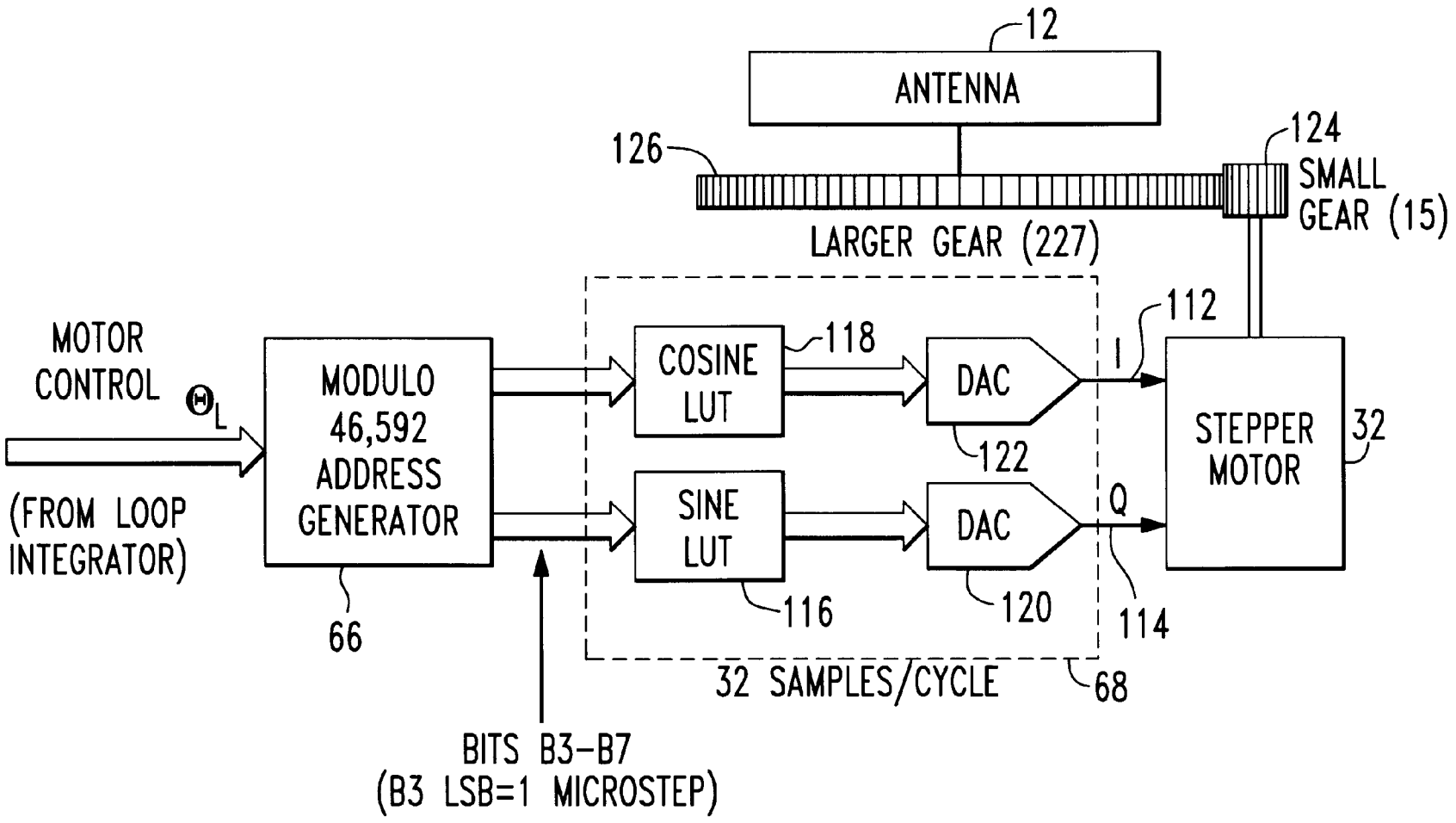
FIG. 6 is a functional diagram of the stepper motor control for the antenna stabilization loop.

A functional block diagram of the motor control function is shown in FIG. 6. The stepper motor is microstep controlled by applying a sine and cosine to its pair of quadrature inputs 112 and 114 which are normally 90 degrees out of phase. This operation is implemented by sine and cosine look-up tables 116 and 118 and digital to analog converters 120 and 122. One full cycle of the sine or cosine corresponds to 4 full motor steps, or equivalently, one step corresponds to 90 degrees of the sine or cosine cycle. There are 48 steps per revolution of this stepper motor, and each step is comprised of 8 microsteps over the 90 degrees of the step. Therefore there are 384 microsteps per motor revolution.

Gears 124 and 126 produce a gear reduction from the stepper motor to the antenna assembly of 15/227. Then each antenna revolution requires exactly 726.4 steps, or 5811.2 microsteps, or 181.6 cycles of the cosine or sine drive signals derived through a look-up table (LUT) and address generator. If a single antenna revolution would correspond to an integer number of LUT cycles, then a modulo operation is simple and exact. Unfortunately this is not the case with the selected gear ratio. The simplest remedy is to force an integer number of LUT cycles over approximately one antenna revolution. For example we can approximate one antenna revolution with 182 LUT cycles (instead of exactly 181.6), where an error of about 0.8 degrees is accumulated for each antenna revolution. This small error can easily be corrected over time by the Tracking Loop Control.

A simple method to implement this position translation is to pick a convenient modulus for the antenna angle representation $\theta_L$. This modulus would be a multiple of the product of the number of microsteps in the LUT cycle (e.g. 32), and the number of LUT cycles in a single antenna revolution (e.g. approximated by 182). It is also desirable to use all the 16 bits of precision to represent $\theta_L$. Using these guidelines this modulus is computed to be 182*32*8=46,592. This modulus allows bits b3 through b7 to be used directly as the 5-bit LUT address (32 samples over the cosine/sine cycle) as highlighted in the $\theta_L$ representation (modulo 46,592) below.

LUT Address: b15 b14 b12 b11 b10 b9 b8 <u>b7 b6 b5 b4 b3</u> b2 b1 b0

Since the stepper motor and the Rate Sensor are mounted together on the rotatable antenna assembly, the closed servo loop is complete with this mechanical connection. The servo motor rotation is in the opposite direction sensed by the rate sensor such that the antenna assembly tends to remain still (in rotation) relative to the inertial reference (earth and satellite) as the vehicle turns.

The rate sensor senses the turning rate of the vehicle in units proportional to degrees per second. When the vehicle is not turning a zero rate voltage (ZRV) is present on the output of the rate sensor. This ZRV can vary by as much as ±0.6 volts from the center (nominal 2.5 volts) of the 0 to 5 volt range. It is important to correct for this offset such that the effective rate error is less than 1 degree/sec. This error tolerance results in a position drift of 15 degrees over a 15 second signal blockage, for example.

The algorithmic strategy of the OPEN LOOP RATE CALIBRATION is to identify rate samples taken when the vehicle is either stopped or on a straight path. These samples have the characteristic (probability density function) where they are tightly clustered about the ZRV (e.g. over about 1 degree per second equivalent from the true ZRV). Although a constant angle turn at a constant speed will also result in a tightly clustered group of samples, the duration of this constant rate is probabilistically short, and the spread (standard deviation) of these samples is larger. The true ZRV samples are distinguished from the samples during random turns which are generally scattered randomly in amplitude away from the ZRV over a much wider range.

Figure 7:
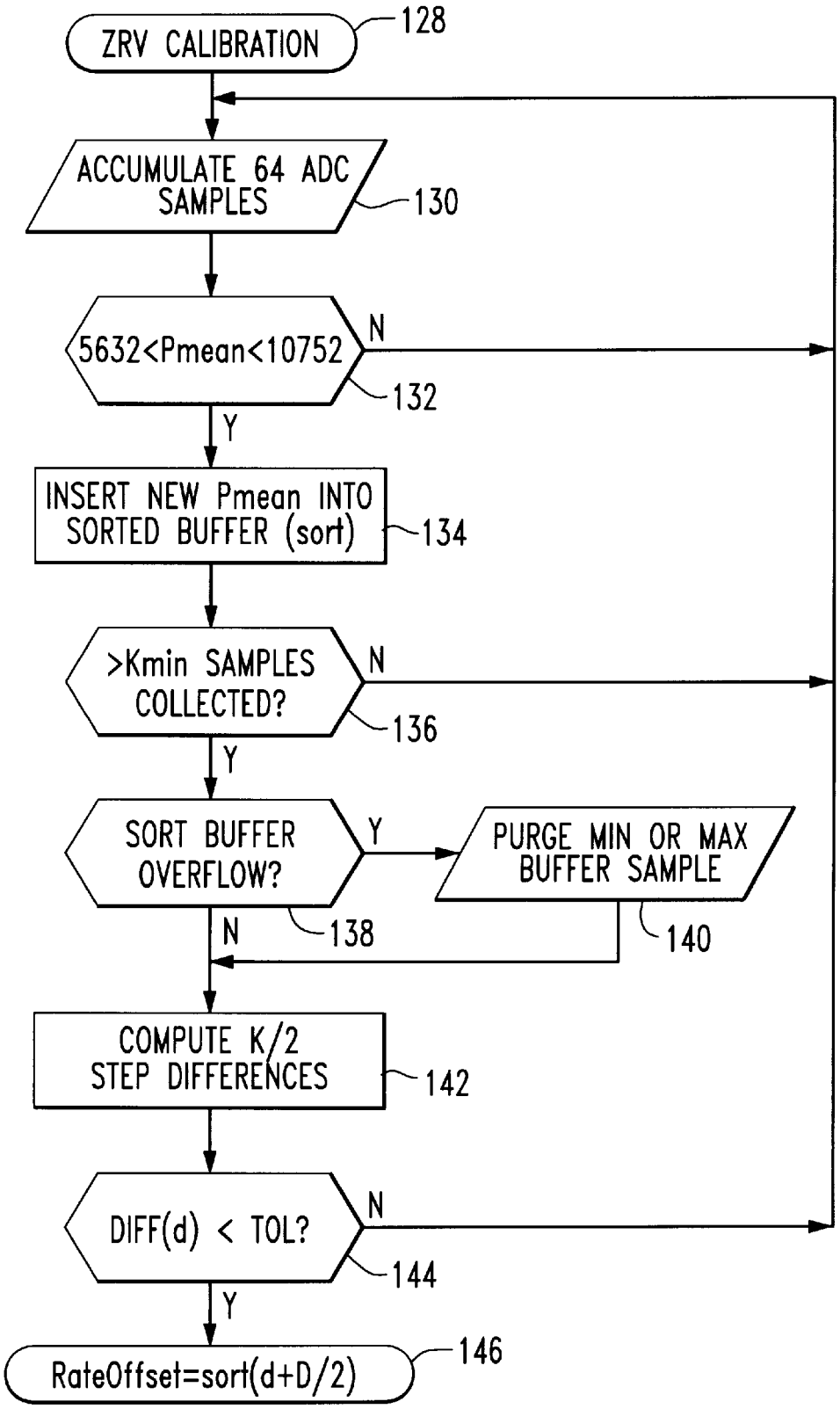
FIG. 7 is a flowchart of the sorted buffer algorithm.

The superior performance of this algorithm over simply estimating the mean is achieved through a Sorted Buffer ZRV Algorithm (SBZRVA) which provides an adaptive multi-step refinement of a median computation. After sorting the samples in the buffer, the algorithm searches for a large (half the buffer size) cluster of samples where the extreme values are within about 0.5 deg/sec apart. When this cluster is found, the estimated ZRV is the median value of this cluster. If the buffer fills without meeting the cluster min-max tolerance, then the minimum or maximum sample of the buffer is purged, whichever is furthest from the buffer median. The algorithm will eventually converge over time, even on winding roads, since the extreme values continue to be purged while the middle values accumulate until the tolerance is reached. A flowchart of this algorithm is presented in FIG. 7. The algorithm is entered in block 128. Block 130 illustrates that rate samples (input at 225 samples/sec) from the 8-bit ADC are summed in blocks of 64 samples to form 14-bit (0 to 16383) partial means.

$$Pmean_m = \sum_{n=0}^{63} ADC_{64\cdot m+n};\quad m = 0, 1, 2 \ldots$$

In block 132, a determination is a made as to whether each partial mean within tolerance (e.g. 2500 mV, ±781 mV at 22.2 mV per deg/sec). If so, block 134 shows that it is inserted into the sorted list of previous length K. This tolerance was chosen such that only the most significant byte need be checked (although both bytes are used in the sorted list if within tolerance).

$$\text{if } (5632 \leq Pmean_m \leq 10752), \text{ then insert into sorted list } sort_k;\ k=0, 1,2 \ldots K-1$$

Block 136 determines if fewer than Kmin samples are in the sorted list, if so, then the procedure is returned to the beginning (and must wait a minimum amount of time before accepting the result).

The list length K is incremented from its previous value before the partial mean was inserted in block 132. Block 138 determines if K is greater than maximum sorted list size Kmax, if so, block 140 shows that either the smallest or largest sample is removed from the list to result in a list size of Kmax.

$$\text{if } K < K\,\text{max, then } K = K + 1$$

$$\text{else if } (sort_0 + sort_K) > 2 \cdot sort_{K/2}, \text{ then remove } sort_K$$

$$\text{else remove } sort_0$$

Block 142 shows that the D-step differences are computed (slide difference window of length D=K/2 through the buffer) and the minimum and its center sample index are determined.

$$diff_d = sort_{d+D} - sort_d;\ d=0,1,2 \ldots K-D-1$$

$$\text{find } d \text{ for which the expression above yields } \min(diff_d)$$

Block 144 shows that if the minimum difference computed in block 148 is greater than the tolerance, then return to the beginning; else the rate offset estimate is computed as the median of the window.

$$\text{if } (diff_d < Tol), \text{ then } RateOffset = sort_{d+D/2}$$

Block 146 shows that the RateOffset value computed in block 142 is then applied to the rate error correction input to the BSC stabilization loop and the algorithm is exited.

The recommended minimum number of samples is Kmin=128 (about 36.4 seconds). The recommended maximum buffer size (samples) is Kmax=256 (about 73 seconds). The recommended tolerance for the sorted buffer is Tol=36 (about 0.5 degrees per second).

Figure 8:
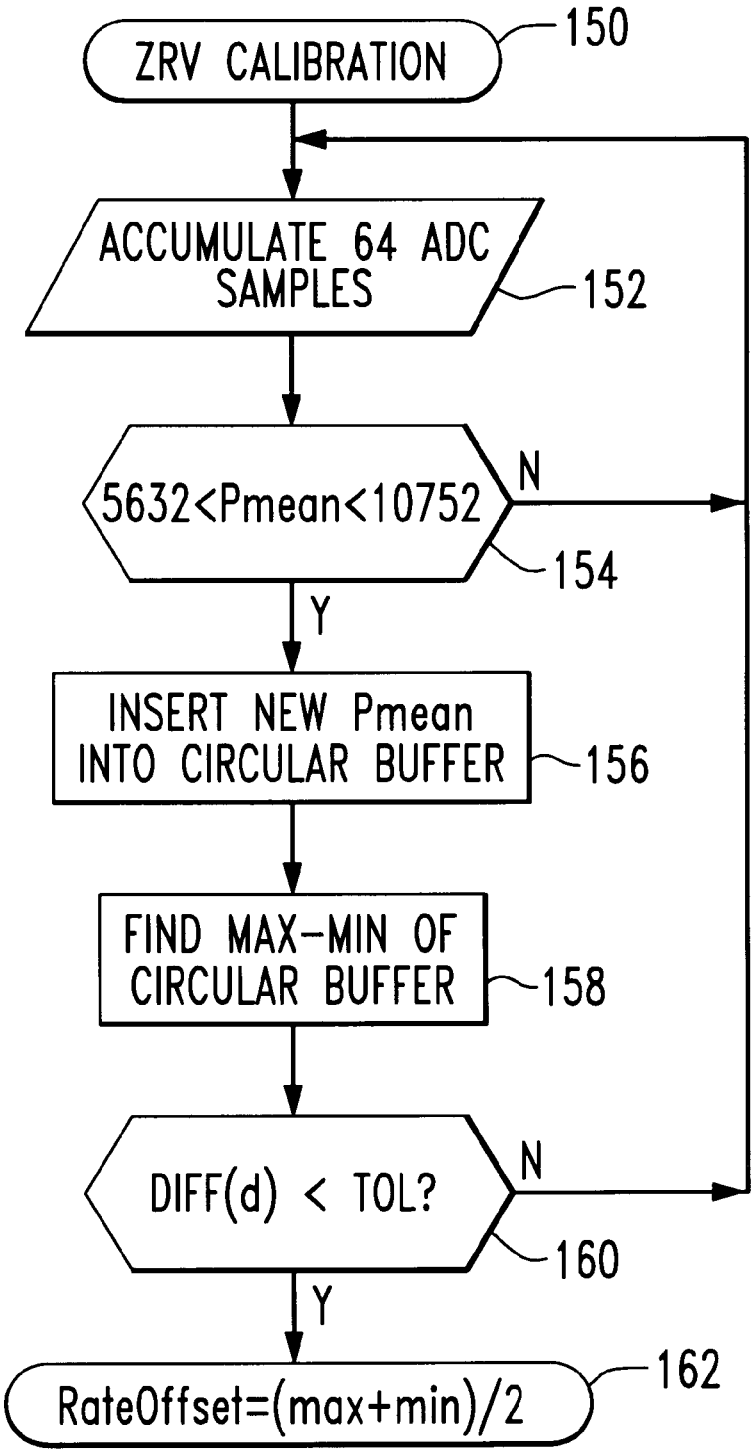
FIG. 8 is a flowchart of the chronological buffer algorithm.

A Chronological Buffer ZRV Algorithm (CBZRVA), which is a variation of the Sorted Buffer Zero Rate Voltage Algorithm, can be performed in parallel with the SBZRVA. This variation attempts to identify if the vehicle is stopped (or moving in a very straight path) by observing the most recent partial means as computed above. These recent partial means could conveniently be handled in a circular buffer. If the difference between the minimum and maximum values over this recent sample set is sufficiently small, then the RateOffset value is computed to be the mean value of these minimum and maximum samples. A flowchart of the Chronological Buffer ZRV Algorithm is presented in FIG. 8. The CBZRVA is entered in block 150. Blocks 152, 154 and 156 correspond to blocks 130, 132 and 134 in FIG. 7.

Block 154 shows that each partial mean within tolerance is inserted into a circular buffer of fixed length B, where the oldest chronological value is removed from the list by replacing it with the newest value.

$$\text{if}(5632 < Pmean_m < 10752), \text{ then}$$
$$\{buffindx = (buffindx + 1) \bmod B$$
$$buffer_{buffindx} = Pmean_m\}$$

The minimum and maximum of the circular buffer is found in block 156, and the difference between the maximum and minimum values in the filled circular buffer is computed as shown in block 158.

$$buffdiff = max(buffer) - min(buffer)$$

If the difference is greater than the chronological buffer tolerance, then the process is started over; else the rate offset estimate is computed in block 160 as:

$$\text{if } (buffdiff < Tol), \text{ then } RateOffset = \frac{\max(buffer) + \min(buffer)}{2}$$

The recommended buffer size for the chronological partial mean samples is B=20 (about 5.7 seconds). The recommended tolerance for buffdiff is Tol=24 (about 0.33 degrees per second). Note the redundancy in the flowchart of FIG. 9 since both algorithms execute in parallel. The algorithm is exited in block 162.

Figure 9:
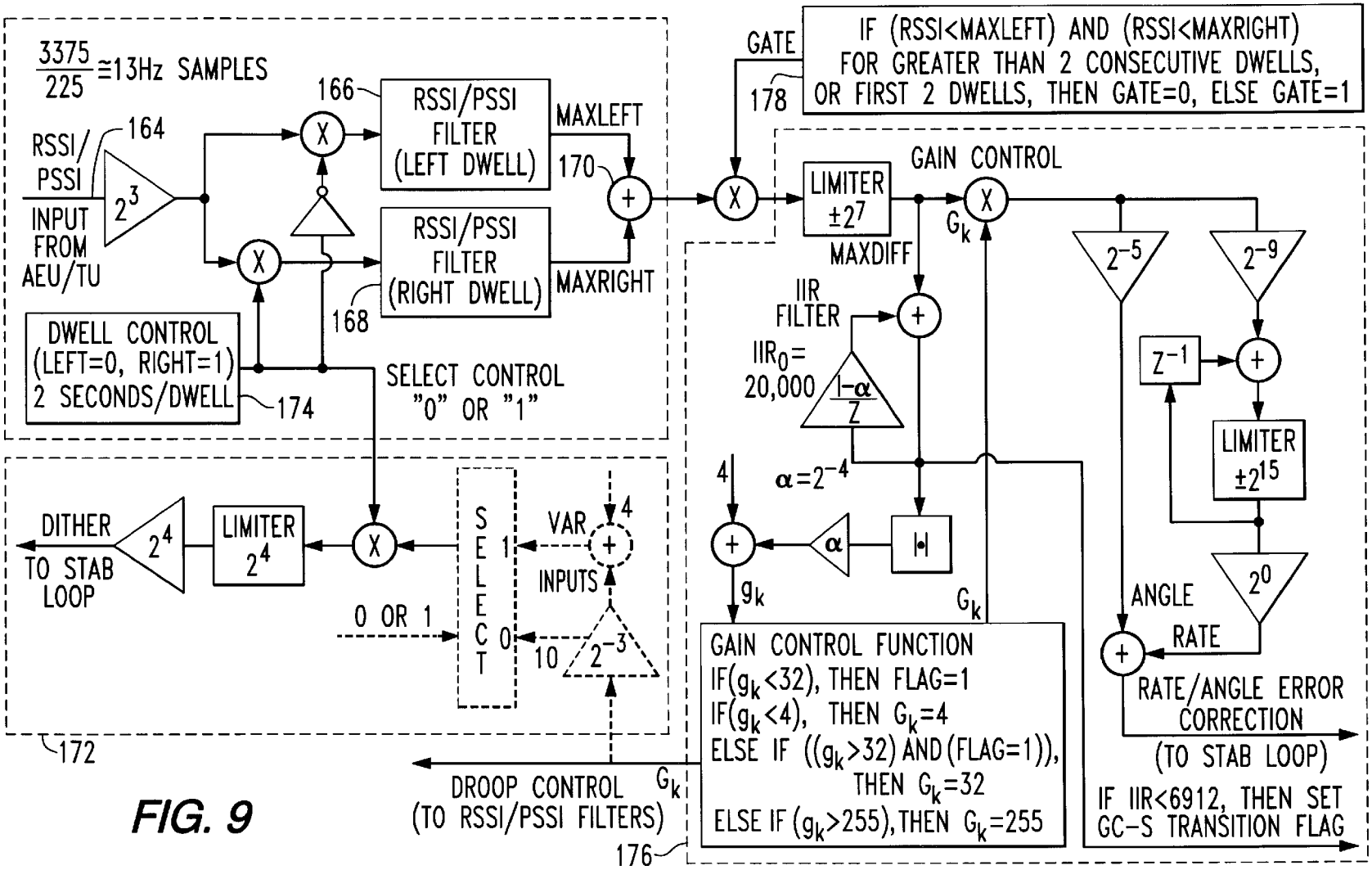
FIG. 9 is a functional block diagram of satellite tracking loop.

FIG. 9 is a block diagram of the components that comprise the Satellite Tracking Loop (STL). The strategy of the STL is to utilize signal strength or SNR measurements to locate the azimuth direction of the satellite. The SNR measurements, labeled either Receive Signal Strength Indicator (RSSI) measurements or Pilot Signal Strength Indicator (PSSI) measurements (depending on whether the Transceiver Unit (TU) is receiving a modulated signal or a pilot signal) are estimated in the Transceiver Unit (TU). In this particular implementation the RSSIs or PSSIs are updated at 3375/256 times per second (approximately 13 Hz) and are appropriately adjusted to represent the Eb/No of a received communications signal (should a call be made) in units of tenths of a dB. The goal of the Satellite Tracking Loop is to point the antenna in the direction of maximum PSSI or RSSI values.

The RSSI or PSSI samples measured during each dwell are input on line 164 and processed through separate left dwell and right dwell nonlinear filters 166 and 168 to estimate the SNR or signal strength of the left dither or right dither dwells. An imbalance of the RSSI or PSSI measurements between the left and right dwells appears at the output of summation point 170 and is indicative of the magnitude and direction of the antenna pointing error. The STL servo mechanism attempts to minimize the observed imbalance.

The steerable antenna is dithered (by circuit 172) about the desired heading to aid in the process of assessing the heading error of the antenna. The antenna is dithered either left (counterclockwise) or right (clockwise) and held by dwell control 174 for a dwell time of about 2 seconds. The size of the dither angle is kept small such that the antenna gain pattern loss at the dither angle is less than a dB relative to boresight.

One goal of the nonlinear filtering of the left and right dwell RSSI/PSSI measurements is to mitigate the effects of signal fades, blockages and voice activation. The fast attack slow decay (FASD) characteristic of the left and right dwell filters allows the output to "coast" over temporary signal fades, blockages, or voice inactivity. The difference between the left and right filtered signals is applied in a closed servo loop 176 around the Stabilization Loop to track the satellite. The time constant of the STL is about 1 minute (in steady state linear approximation model), compared to the Stabilization Loop time constant of less than 1 second. The relatively long time constant of the STL is necessary to prevent erroneous reactions of the loop to short term fades or blockages, but fast enough to correct errors due to rate sensor drift and other accumulated errors. Block 178 shows that the error signal is gated according to the maximum RSSI signals.

An expression for the antenna tracking error signal (used in the closed-loop STL) as a function of the antenna's 3 dB beamwidth, the dither angle, and the heading or tracking error itself can now be derived. It is customary to assume that the beam pattern around the peak can be approximated by:

$$P(\theta) = e^{-d\cdot\theta^2}, \text{ where } d = \frac{4\cdot\ln(\sqrt{2})}{Beamwidth^2}$$

where the gain is normalized to unity at boresight. For example, when the beamwidth is 44 degrees, the constant is evaluated to be d≅0.000716. The log of the beam pattern is:

$$ln(P(\theta)) = ln(e^{-d\cdot\theta^2}) = -d\cdot\theta^2$$

In units of dB, the beam pattern is defined as:

$$PdB(\theta) = 20\cdot log(e^{-d\cdot\theta^2}) = -d\cdot\theta^2\cdot 20\cdot log(e) \equiv -c\cdot\theta^2, \text{ where } c = 20\cdot d\cdot log(e)$$

With a beamwidth of 44 degrees, the constant is evaluated to be c≅0.00622. The Receive Signal Strength Indicator (RSSI) defined in Eb/No dB, relative to 0 dB at boresight, is used to produce the error signal in the loop.

$$RSSI \equiv -c\cdot\theta^2$$

An error signal is produced by computing the difference in estimated RSSI dB values between left and right symmetric dither dwells. The dithering is performed at $\pm\theta_d$ from the estimated heading angle $\theta_h$ relative to the true satellite azimuth. The resulting difference is:

$$RSSI_L - RSSI_R = -c\cdot(\theta_h+\theta_d)^2 + c\cdot(\theta_h+\theta_d)^2 = -4\cdot c\cdot\theta_d\cdot\theta_h$$

This result shows that the error signal (dB) is proportional to the product of the dither angle and the heading error. When the dither angle is ±5 degrees and the beamwidth is 44 degrees, then the error signal is $RSSI_L - RSSI_R \cong 0.1244 \cdot \theta_h$. A larger dither angle improves the measurement (gain) of the error signal at the expense of larger dither loss. A trade-off is necessary to weigh the relative benefits of an improved error signal to minimize the heading error versus $\theta_h$ dither loss as a function of $\theta_d$. Furthermore the magnitude of the dither angle can be varied as a function of the estimated pointing error or noise in the loop. A plot of the dither angle versus dither loss is presented in FIG. 10.

The primary purpose of the STL is to compensate for the dc offset error in the rate sensor portion of the Stabilization Loop. Other smaller errors such as rate sensor nonlinearity, quantization errors and gain errors are also corrected (over a relatively longer term) by the Tracking Loop. A dc offset in the rate sensor is integrated within the Stabilization Loop to result in a linear position change rate over time. This effect s because the STL error correction is applied to the rate offset input of the stabilization while the output of the Stabilization Loop is assumed to be the azimuth position. Therefore the Stabilization Loop portion of the Tracking Loop with the rate correction as the input can be modeled approximately as a position integrator with a fixed gain. The Stabilization Loop maintains the azimuth angle of the antenna relative to an inertial reference (the earth, or a communications satellite) independent of the vehicle motion (e.g. turns) such that the antenna continues to point to the satellite even when the signal is lost due to a temporary blockage. The PSSI measurements are used to indicate the relative power of the pilot signal. Signal to Noise Ratio (SNR) is actually used to indicate the signal strength relative to the measured noise floor in the receiver. The pilot signal is used for the satellite search and initial tracking of the signal from the satellite, as well as for recovery from loss of signal and large tracking errors. The pilot provides a better means of acquiring and tracking the satellite than a modulated signal. These PSSI measurements are updated periodically (e.g. 13 Hz rate) to provide signal strength information to the STL.

Each PSSI value is calculated for a Pilot channel by computing 8 successive 256-point complex DFTs over contiguous blocks of pilot samples at a rate of 8 (for example) complex samples per symbol. For example, at a 3375 Hz symbol rate, each DFT spans approximately 9.48 milliseconds (76 msec total per PSSI). The energy in each frequency bin is computed (sum of squares of imaginary and real components) for the 8 DFTs, and the energies of the corresponding frequency bins across the 8 DFTs are summed. The result is representative of the average power energy spectral density consisting of discrete frequency bins each 105.45 Hz wide (for example).

Next this energy-averaged DFT, which we will call the power spectral density (PSD), is processed to detect and estimate the SNR of a potential narrowband pilot. A Hamming window function is used with the FFT to reduce potential sidelobe levels due to rectangular truncation (Gibb's phenomonen). The pilot is searched by sliding the center of a search window across approximately ±5 kHz, allowing for reference frequency error. The sum of the 3 center bins of the search window is representative of the power of a potential pilot. The sum of the third through 19th bins on both sides of the center is representative of the noise power. The maximum ratio of the pilot power to the noise power is determined over the center frequencies within the search window. If this maximum ratio exceeds a predetermined pilot detection threshold, then the pilot is assumed detected and the measured ratio represents the SNR. Specifically this ratio is equivalent to the Es/No for a modulated QPSK signal which has the same power as the pilot (assuming 8 complex samples per QPSK symbol). This SNR is computed over a range limited between 0 and 25.5 dB (e.g. 10*log(ratio)). Additionally the center frequency determined by the FFT bin location can be used to calibrate a (local) frequency synthesizer within the mobile terminal.

The Receive Signal Strength Indicator (RSSI) values are computed using the post detection soft decision symbol values from the matched filter of the QPSK demodulator. The RSSI values are computed only after acquiring (carrier and symbol acquisition) the modulated channel signal. Each RSSI computation is performed over 256 QPSK symbols in four 64-symbol portions. It should be noted that, although the RSSI and the PSSI measurements yield the same result in the absence of fading for equal power modulated or CW signals respectively, the RSSI estimate is adversely affected by multipath fading while the PSSI is less affected. To mitigate against fading and bursty signals, the 4 SNR estimates over each RSSI period are processed according to the following 2 rules.

Rule 1: If all 4 SNR estimates over an RSSI period are above a minimum threshold (e.g. 1 dB) then the 4 SNR estimates are averaged (in dB) to form the RSSI measurement.

Rule 2: If any of the 4 SNR estimates over an RSSI period are lower than minimum threshold (e.g. 1 dB) then the highest SNR estimate is used to form the RSSI.

The rationale for the 2 rules is as follows. Rule 1 is in effect when the signal is detected over the full RSSI period (i.e. 256/3375 sec). Averaging all 4 discrete SNR measurements in this case improves the RSSI estimate accuracy. However when one of the 4 SNR measurements within an RSSI period measures below 1 dB, it is assumed that either the signal is temporarily blocked or faded, or a Channel Activity Burst (CAB) was transmitted. When voice is not being transmitted (during a voice call), a 38-msec Channel Activity Burst (CAB) is transmitted every 480 msec and the signal is off between CAB transmissions. The SNR estimate block size of 64 symbols ensures that the SNR of a CAB will be detected since at least one 64-symbol block lies fully within a CAB. These Eb/No estimates are converted to dB values ranging from 0 to 25.5 dB at a rate of about 13 Hz (3375/256) for use in the STL.

The signal power (energy), the noise power (energy), and the RSSI values can be estimated via appropriate processing of the matched filter outputs taken once each complex QPSK symbol. This particular method does not rely on phase or accurate frequency synchronization because the complex symbol energy used as the input to the estimator(s) is invariant to phase. The discrete RSSI estimates are performed over blocks of 64 or 256 complex samples.

The sum of the squares of the punctually timed symbol outputs $x_k$ of the matched filter is defined as:

$$x_k \equiv (d_{1,k}+n_{I,k})^2+(d_{Q,,k}+n_{Q,,k})^2 \equiv (d_0+n_0)^2+(d_1+n_1)^2$$

In the expression above $d_0$ and $d_1$ represent the detected signal data levels which can assume values of ±d volts, for example. The $n_0$ and $n_1$ represent the independent AWG noise terms. Notice that any arbitrary phase rotation of the matched filter output would not affect this resultant.

A filter is used to derive a pair of estimates defined as:

$$\bar{x} \equiv E\{x\} = E\{d_0^2+2\cdot d_0\cdot n_0+n_0^2+d_1^2+2\cdot d_1\cdot n_1+n_1^2\} = 2\cdot(d^2+\sigma_n^2)$$

and $$\overline{x^2} \equiv E\{x^2\} = E\{[2\cdot d^2+2\cdot d\cdot(n_0+n_1)+(n_0^2+n_1^2)]^2\} = 4\cdot d^4+16\cdot d^2\cdot\sigma_n^2+8\cdot\sigma_n^4$$

Note that if $E(n^2)=\sigma_n^2$ then $E(n^4)=3\cdot\sigma_n^4$ for Gaussian random variables (n). These estimates are performed over blocks of K=64 samples where the mth block of K samples identifies the filter output index.

$$\overline{x}_m = \frac{\sum_{k=0}^{K-1} x_{k+m\cdot K}}{K} \qquad \overline{x_m^2} = \frac{\sum_{k=0}^{K-1} x_{k+m\cdot K}^2}{K}$$

Estimates of the signal energy, the noise variance, and the SNR can be computed as follows:

$$2\cdot\overline{x_m}^2 - \overline{x_m^2} = 4\cdot d^4; \quad d^2 = \frac{\sqrt{2\cdot\overline{x_m}^2 - \overline{x_m^2}}}{2}$$

$$\sigma_n^2 = \frac{\overline{x_m}}{2} - d^2$$

$$SNR \equiv \frac{d^2}{\sigma_n^2}$$

Figure 10:
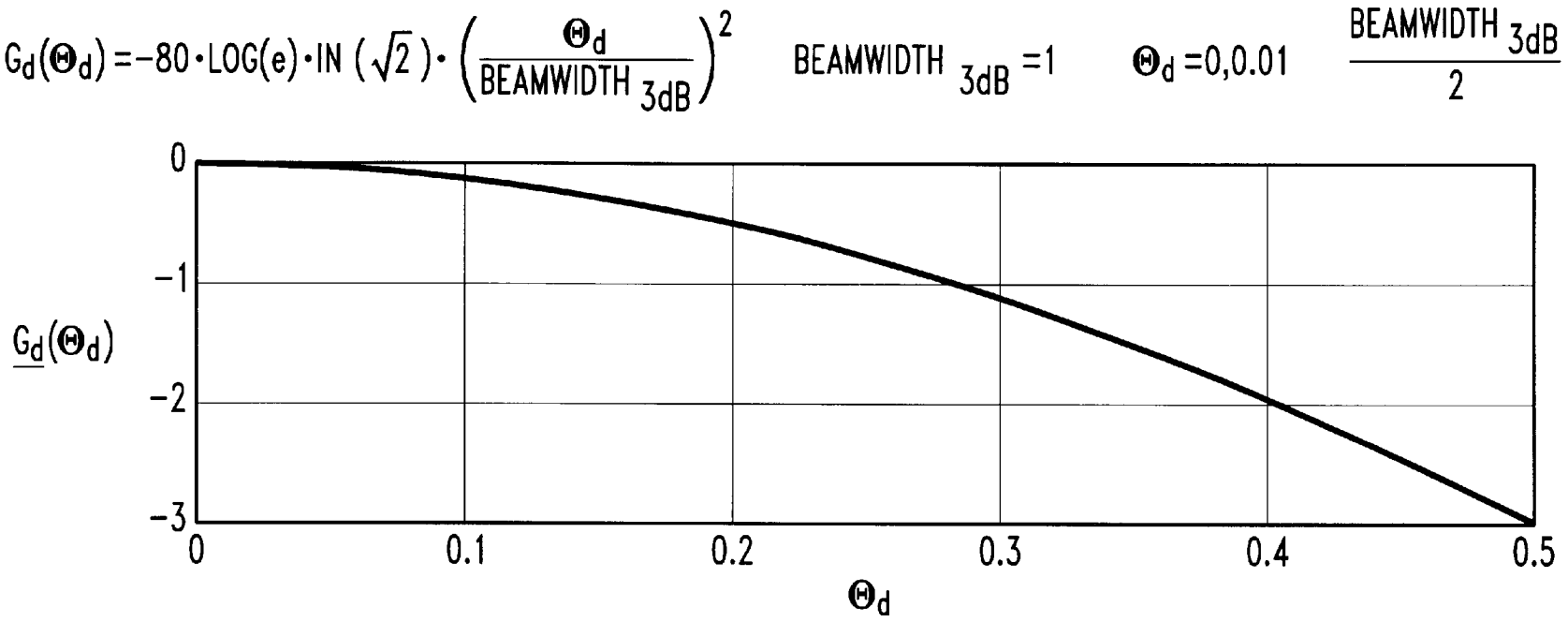
FIG. 10 is a flowchart of the satellite acquisition azimuth search algorithm.

A peak detection algorithm over each dither dwell can be used to estimate the signal level while mitigating the effects of fading, blockages, or absence of voice activity when the transmitted signal is suppressed. This peak detector has a fast attack slow decay (FASD) nonlinear filter characteristic which is implemented in each left and right dither filtering. The filter computation is:

$$y_k = \begin{cases} (1-\alpha)\cdot y_{k-1} + \alpha\cdot x_k; & \text{if } x_k > y_{k-1} \\ y_{k-1} - droop_k; & \text{otherwise} \end{cases}$$

where $droop_k = G_k\cdot 2^{-6} + 2 + boost_k$; and $$boost_k = \begin{cases} 4; \text{ if flywheeling}(GATE = 0) \\ 0; \text{ otherwise} \end{cases}$$

where y is the filter output and x is the PSSI or RSSI filter input in dB (or tenths of a dB in our implementation). Note that the filtering in dB uses a droop subtraction instead of a multiplicative droop decay factor. If the droop parameter is set to 1/40 dB, for example, the filter output will droop at a rate of approximately 0.33 dB per second (assuming 13 Hz sample rate) when no signal is present. The droop in the present implementation is adaptively variable as a function of parameters $G_k$ and GATE as shown in FIG. 9. The adaptive feature is especially useful for acquisition when the rate sensor offset error is typically large. In the absence of a received signal, the droop rate should be roughly equivalent to the average antenna pointing error loss rate due to a worst case rate sensor residual offset error over a 3 dB range. For example, if the residual rate sensor offset error is 1 degree per second, then the 3 dB error will occur after 15 seconds (3 dB beamwidth=±15 degrees). Then the droop rate should be approximately 3 dB per 15 seconds. This (linearized) droop rate is equivalent to about 0.015 dB per sample (assuming 13 samples/sec) or about 0.2 dB per second. A droop boost feature is added to temporarily increase the droop when large changes in signal level are detected. A plot of the dither angle vs. dither loss is shown in FIG. 10.

Figure 11:
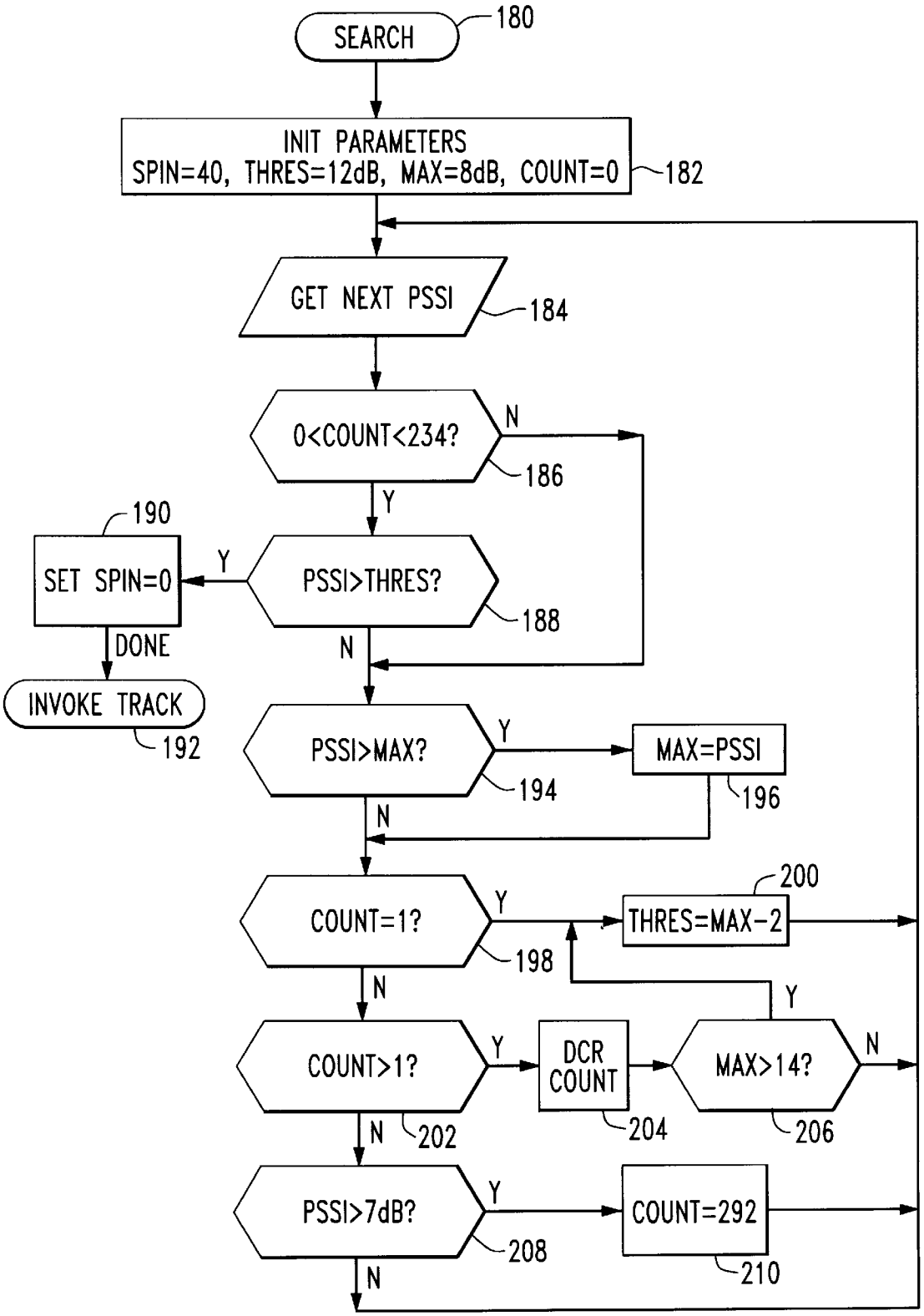
FIG. 11 is a plot of dither angle vs. dither loss (dB)

A flowchart describing the Satellite Azimuth Acquisition Search Algorithm is shown in FIG. 11. The search algorithm is entered at block 180 after enabling the antenna inertial stabilization loop. The stabilization loop aids the search by suppressing the effects of vehicle turns. Parameters that are initialized in block 182 include the spin rate of the antenna (SPIN=40 degrees/second), the "signal main lobe detection" threshold of 12 dB Eb/No, a starting minimum signal level of MAX=8 dB, and the control variable/timer COUNT=0. The goal of the algorithm is to point the main lobe of an azimuth steerable antenna toward the satellite such that the Satellite Tracking Algorithm can commence. Once the antenna's main lobe is pointed, the satellite tracking algorithm is invoked.

A threshold value (THRES) is used to set the minimum signal level (Eb/No in dB) of the main lobe for detection purposes. The algorithm initially sets the threshold at a high value, then eventually adjusts the threshold in a manner to prevent antenna sidelobe detection. The COUNT variable is used both to control the various "submodes" of the algorithm, and as a timer to ensure sufficient rotations of the antenna before the threshold is tested and adjusted, if necessary. In addition, if a very strong signal is present, then the threshold is raised to prevent stopping on a sidelobe. After the first PSSI value exceeds a minimum signal detection level of 7 dB, then the timer (COUNT) is started. If the main lobe is not detected before the timer expires, then the main lobe detection threshold THRES is lowered to a value that is 2 dB below the maximum signal level previously detected. This algorithm is designed to be tolerant of intermittent signal blockages.

The PSSI value is retrieved as shown in block 184. Block 186 shows that if the count is between zero and 234, the PSSI is compared to the threshold in block 188. If the threshold is exceeded, the spin is set to zero in block 190 and tracking is invoked in block 192. If the PSSI does not exceed the threshold, it is compared to the maximum value in block 194 and set to the maximum value in bloc 196 if it exceeds that maximum. Block 198 determines if the count is equal to one. If so, the threshold is set to two less than the previous maximum in block 200. If the count is greater than one in block 202, it is decremented in block 204 and the maximum value is checked in block 206. If the PSSI is greater than 7 dB in block 208, the count is et to 292 in block 210.

Figure 12A:
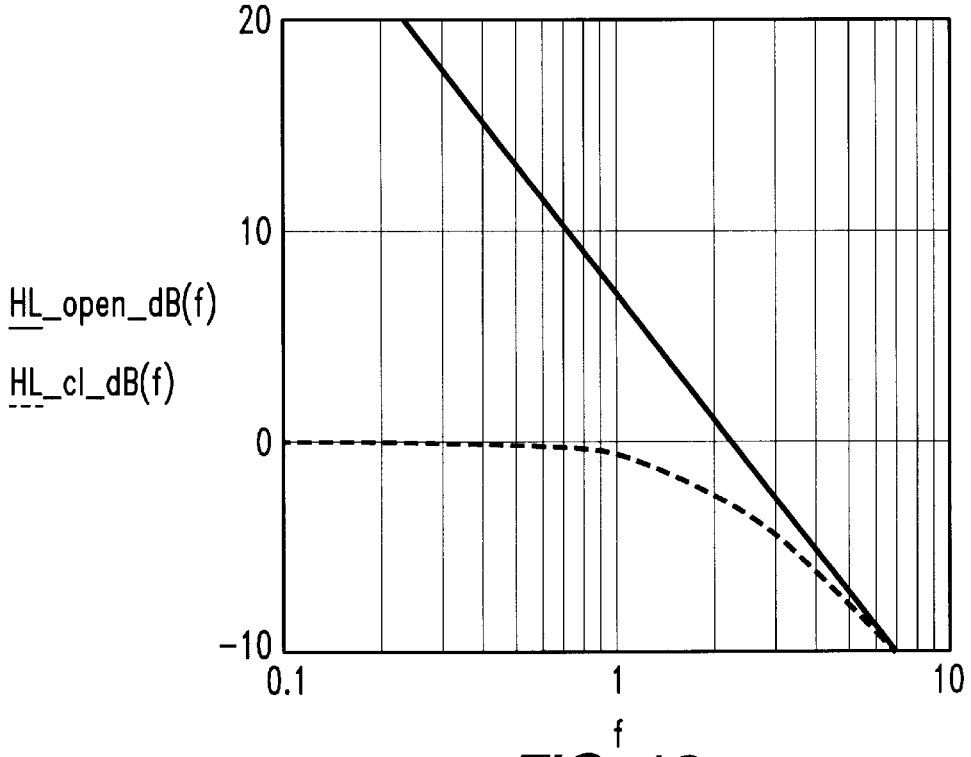
FIG. 12 shows open and closed loop gain and phase plots of the acceleration/rate limiter portion of the stabilization loop analysis model.
Figure 12B:
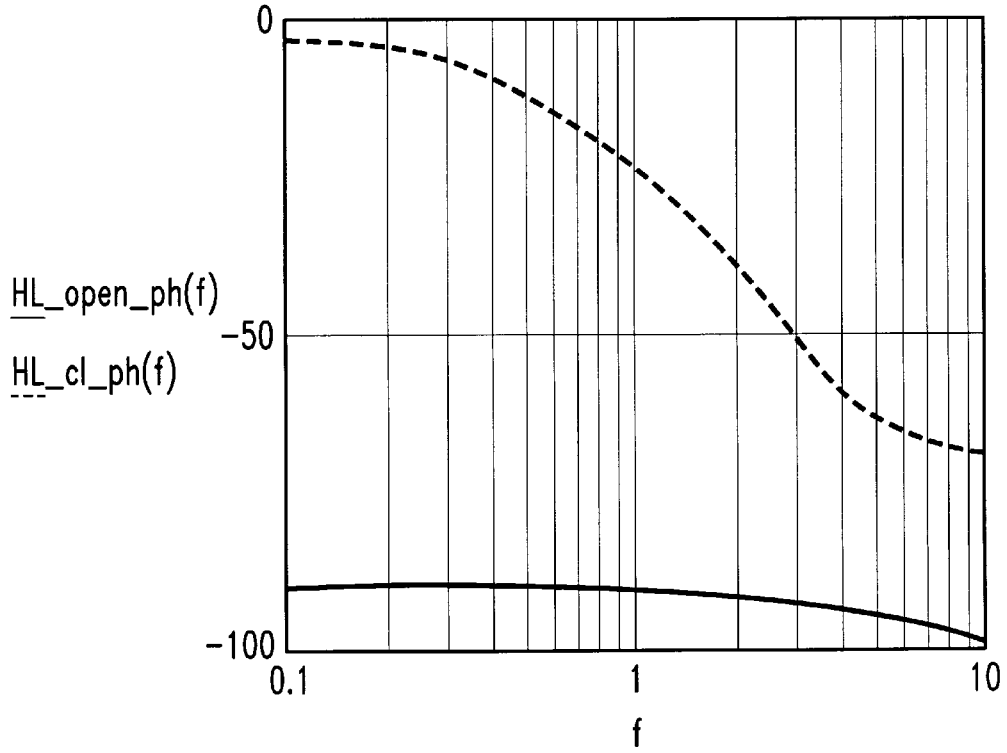

FIG. 12*a* is a plot of the open loop gain. FIG. 12*b* is an open and closed loop phase plot.

Although specific parameter values have been selected here specifically for the Westinghouse Land-Mobile Medium Gain Contour Antenna, this technique can apply to a much broader range of steerable antennas.

The important features of the Satellite Acquisition are summarized as follows:

1. The algorithm does not start the search timer (COUNT) until a signal of at least 7 dB is detected (a low Marginal signal level)
2. The COUNT variable and logic is used to ensure that the antenna spins 180 degrees after initially detecting a signal of at least 7 dB before the spinning is allowed to stop. This ensures that the antenna has searched past the true peak of the beam, which it stores at the MAX value. This improves the tolerance to blockages and prevents the algorithm from prematurely stopping on the wrong side of the beam.
3. The MAX signal is dynamically updated and used to adjust the threshold to ensure that the search (spinning) stops within 2 dB of the measured peak of the beam.
4. The algorithm ensures that the antenna rotates at least 1+ times to find the signal, and at least 3 times when the signal is Marginal. This improves the tolerance to blockages and ensures that the peak of the beam is chosen, and not a sidelobe.
5. Outside of this algorithm, a software timer limits the time to search for the signal.

A Beam Steering Control System for mobile azimuth-steered antenna used in a mobile satellite terminal has been described. This design has been simulated and tested in laboratory, land-mobile and maritime environments and performs well (<0.7 dB loss for 90% of the time in the absence of fades and blockages).

A technique for stabilizing the beam steered antenna used in a moving vehicle was described. This loop was designed, analyzed, fabricated and tested. The stabilization loop was simulated and demonstrated to maintain the azimuth angle of the antenna relative to an inertial reference (the earth, or a communications satellite) independent of the vehicle motion (e.g. turns) such that the antenna continues to point to the satellite even when the signal is lost due to a temporary blockage.

The calibration and signal processing methods employed in the Stabilization Loop achieve an overall low hardware cost through use of low-cost components. The primary components of the Stabilization Loop consist of the Antenna Assembly, a turn rate sensor, a stepper motor, a pair of 5-bit D/A converters and a low-cost single chip microcontroller device with built-in 8-bit A/D converter. The microcomputer chip performs all the Stabilization Loop functions including the dither noise generation, rate sensor compensation and overload protection, acceleration and rate limiting, and other miscellaneous loop and motor control functions. The noise dither technique, using the PN sequence with oversampling and filtering, allowed the use of the 8-bit microcontroller's A/D converter. Dynamic calibration of the rate sensor within the closed loop allowed the use of an inexpensive rate sensor device instead of a more expensive compass. It is demonstrated here that the rate sensor calibration and drift problems are solved. A lower cost Stabilization Loop yielding higher performance than the compass is achievable with the rate sensor. Important features of this implementation of a Satellite Tracking Loop include the methods of digital signal processing for fade mitigation and component gain variations, self calibration/normalization methods, and the methods to deal with signals over a wide dynamic range which permit the use of very low cost, but reliable, hardware components. Adaptive parameters such as dynamic loop gain control, adaptive droop for filters, and blockage detection and control (GATE function), enhance the performance of the Satellite Tracking Loop (STL). The method for beam steering a mobile satellite communications antenna includes several algorithmic functions that provide particular performance improvements. The oversampling and noise dithering techniques employed at the A/D converter 34 and Filtered PN Code Sequence 36, respectively, have the effect of increasing the effective bits of resolution in the bandwidth of the rate sensor (rate sensor bandwidth of about 7 Hz) requires a sample rate of at least 14 Hz, where this invention sample rate is 225 Hz increasing effective resolution by about 2 bits. Rate Sensor Overload Protection 56 eliminates errors due to Rate Sensor 28 limiting by automatically rotating the antenna assembly in the direction to reduce the measured rate when it senses that the rate sensor is approaching an overload condition. The Acceleration and Rate Limiter 62 prevents the stepper motor 32 from overload and losing lock. The Overshoot Inhibitor 106 predicts the occurrence of an overshoot condition and limits the appropriate control signal to prevent overshoot. The nonlinear RSSI/PSSI filters 166 and 168 allow the antenna control to tolerate signal fade or outage conditions by "flywheeling" when it detects that the signal is lost. The nonlinear processing in the Gain Control Function 176 suppresses undesirable reaction of the linear feedback loop during anomalies and smoothes tracking performance when the signal is good while allowing fast signal reacquisition after loss of the signal.

A communications Satellite Acquisition Technique for a beam steered antenna used in a mobile satellite terminal was described. This Satellite Acquisition Algorithm design has been simulated and tested in laboratory, land-mobile and maritime environments and has demonstrated very good performance with typical mobile channel impairments such ad fading and blockages.

What is claimed is:

1. A beam steering control for a mobile satellite communications antenna, comprising:

an antenna having a steering mechanism;

a dynamic rate sensor for producing a first signal related to the rate of change of position of a vehicle to which said antenna is mounted;

a control system for controlling said steering mechanism in response to the first signal, said control system including a satellite tracking loop and an inertial stabilization loop, said inertial stabilization loop having means for dynamically calibrating said rate sensor, and a satellite acquisition means for determining an azimuth angle of said antenna relative to an inertial reference; and said means for dynamically calibrating said rate sensor including means for estimating a zero rate voltage of said rate sensor responsive to a probability density function of samples of said first signal.

2. A beam steering control for a mobile satellite communications antenna according to claim 1, where said inertial stabilization loop comprises:

a microcomputer for monitoring the first signal and for controlling the steering mechanism.

3. A beam steering control for a mobile satellite communications antenna according to claim 1, where said means for estimating a zero rate output voltage of said rate sensor comprises means for combining said samples with a digital dither noise signal.

4. A beam steering control for a mobile satellite communications antenna according to claim 1, where said means for estimating a zero rate output voltage of said rate sensor comprises:

a first control loop for estimating the zero rate voltage when the vehicle upon which the antenna is mounted is moving; and a second control loop for estimating the zero rate voltage when the vehicle upon which the antenna is mounted is not moving.

5. A method for beam steering a mobile satellite communications antenna, comprising:

mounting an antenna on a steering mechanism;

using a dynamic rate sensor to produce a first signal related to the rate of change of position of a vehicle to which said antenna is mounted;

producing a second signal representative of an azimuth angle relative to an inertial reference;

controlling said steering mechanism in response to the first signal and said second signal; and dynamically calibrating said rate sensor, including the step of estimating a zero rate voltage of said rate sensor responsive to a probability density function of samples of said first signal.

6. The method for beam steering a mobile satellite communications antenna as recited in claim 5, further comprising the step of:

initially controlling the steering mechanism with an acquisition algorithm.

7. The method for beam steering a mobile satellite communications antenna as recited in claim 5, further comprising the step of:

suspending the step of controlling said steering mechanism during calibration of the rate sensor.

8. The method for beam steering a mobile satellite communications antenna as recited in claim 5, wherein the step of controlling the steering mechanism comprises the step of:

maintaining the azimuth angle of the antenna relative to an inertial reference.

9. The method for beam steering a mobile satellite communications antenna as recited in claim 5, wherein the step of controlling the steering mechanism comprises the steps of:

using a satellite tracking loop to provide long term control of the steering mechanism; and using an inertial stabilization loop to provide short term control of the steering mechanism.

10. The method for beam steering a mobile satellite communications antenna as recited in claim 5, wherein the step of dynamically calibrating the rate sensor comprises the steps of:

continually estimating said zero rate output voltage of the rate sensor to accommodate temperature drift of the output voltage.

11. The method for beam steering a mobile satellite communications antenna as recited in claim 5, wherein the step of controlling the steering mechanism comprises the step of:

automatically rotating the antenna in a direction to reduce the first signal when the first signal approaches an overload condition.

12. The method for beam steering a mobile satellite communications antenna as recited in claim 5, wherein the step of controlling the steering mechanism comprises the step of:

limiting the rate of rotation of the antenna to prevent loss of signal lock.

13. The method for beam steering a mobile satellite communications antenna as recited in claim 5, wherein the step of controlling the steering mechanism comprises the step of:

predicting the occurrence of an overshoot in the rotation of the antenna: and limiting rotation to prevent said overshoot.

14. The method for beam steering a mobile satellite communications antenna as recited in claim 5, wherein the step of controlling the steering mechanism comprises the step of:

producing a control signal for controlling rotation of said antenna, said control signal continuing to operate upon loss of an incoming signal by the antenna.

15. The method for beam steering a mobile satellite communications antenna as recited in claim 5, wherein the step of controlling the steering mechanism comprises the step of:

producing a control signal for controlling rotation of said antenna; and subjecting said control signal to a non-linear gain to provide tracking during signal reception by the antenna and signal reacquisition after signal loss by the antenna.

16. The method for beam steering a mobile satellite communications antenna as recited in claim 5, further comprising the step of:

increasing the resolution of the rate sensor by over sampling and noise dithering.

17. The method for beam steering a mobile satellite communications antenna as recited in claim 5, wherein the step of dynamically calibrating the rate sensor comprises the steps of:

calculating said zero rate voltage using a first algorithm when the vehicle carrying said antenna is moving; and calculating said zero rate voltage using a second algorithm when the vehicle is not moving.

18. The method for beam steering a mobile satellite communications antenna as recited in claim 17, wherein:

said first algorithm comprises a sorted buffer algorithm; and said second algorithm comprises a chronological buffer algorithm.

19. The method for beam steering a mobile satellite communications antenna as recited in claim 18, wherein:

said chronological buffer algorithm estimates said zero rate voltage faster than said sorted buffer algorithm.

* * * * *